US007317118B2

(12) United States Patent
Lo

(10) Patent No.: US 7,317,118 B2
(45) Date of Patent: Jan. 8, 2008

(54) MODEL CAR HAVING ADJUSTABLE PARTS

(76) Inventor: Ricky Lo, Unit 2401A, 24/F., Park-in Commercial Centre, 56 Dundas Street, Mong Kok, Kowloon Hong Kong (CN)

( * ) Notice: Subject to any disclaimer, the term of this patent is extended or adjusted under 35 U.S.C. 154(b) by 200 days.

(21) Appl. No.: 11/050,520

(22) Filed: Feb. 3, 2005

(65) Prior Publication Data

US 2006/0172660 A1 Aug. 3, 2006

(51) Int. Cl.
*A63H 17/26* (2006.01)

(52) U.S. Cl. ..... 556/466; 446/469

(58) Field of Classification Search ..... 446/93–95, 446/466, 469

See application file for complete search history.

(56) References Cited

U.S. PATENT DOCUMENTS

| | | | | |
|---|---|---|---|---|
| 4,850,929 | A * | 7/1989 | Genevey | 446/466 |
| 5,671,934 | A * | 9/1997 | Harrod | 280/87.05 |
| 5,785,576 | A * | 7/1998 | Belton | 446/466 |
| 6,394,878 | B1 * | 5/2002 | Wang | 446/469 |
| 6,604,982 | B1 * | 8/2003 | Croteau-Brooks | 446/466 |
| 2002/0077025 | A1 * | 6/2002 | Wu | 446/466 |

* cited by examiner

*Primary Examiner*—Eugene Kim
*Assistant Examiner*—Urszula M Cegielnik
(74) *Attorney, Agent, or Firm*—Charles C. H. Wu; Wu & Cheung, LLP

(57) ABSTRACT

A model car with a simple mechanism for adjusting its look and feel is provided. The model car has a means for adjusting a height between a base of the model and a surface. In addition, the model car also has a means for adjusting an angle between the base of the model and at least one wheel.

2 Claims, 3 Drawing Sheets

MODEL CAR HAVING ADJUSTABLE PARTS

REFERENCE TO RELATED APPLICATIONS

This application claims an invention which was disclosed in a Chinese patent application entitled "Model Car Having an Adjustable Car Suspension Height and Camber" filed in China on the date of Aug. 10, 2004. The benefit under 35 USC § 119 of the Chinese patent application is hereby claimed, and the aforementioned application is hereby incorporated herein by reference.

BACKGROUND OF THE INVENTION

1. Field of the Invention

The invention pertains to the field of model cars. More particularly, the invention pertains to an adjustable model car.

2. Description of Related Art

It is known to produce model cars. Model cars are produced to look virtually the same as the actual car or automobile used by people as the means for transportation. When a type of car is rolled out of the assembly line, a virtually identical model car to the same type may very well be produced correspondingly to meeting the demands of the collectors.

U.S. Pat. No. 6,478,655 discloses a remote control model car that includes a rear suspension mechanism mounted in either side of the chassis. The chassis has a suspension body. The rear suspension mechanism includes a pivotal adjustment rod coupled to the lug of the suspension body, a pivotal arm mechanism, a hub mechanism, and a shock absorber pivotably secured to the arm mechanism and the suspension body. This arrangement allows for a smooth, simple, and reliable wheel angle adjustment.

U.S. Pat. No. 6,599,169 discloses a suspension system for a toy vehicle. The suspension system is independent in that it comprises at least four damping mechanisms (shock absorber), each shock absorber being located proximal to each wheel location. Each shock absorber utilizes a tensioning device, such as a compressed spring, positioned between the toy vehicle chassis and a suspension arm, to provide the active damping feature of the invention. Each shock absorber also utilizes an adjustment means, such as a screw, to selectively change the distance between the suspension arm and chassis. As the screw is adjusted, so the spring is either more or less compressed, providing for a stiffer (more compressed) or a softer (less compressed) suspension. Furthermore, adjusting the screw to compress the spring causes the body of the toy vehicle to be lowered relative to the suspension arm/wheel assembly, and adjustment of the spring to decrease the spring compression causes the body of the toy vehicle to be raised relative to the suspension arm/wheel assembly.

U.S. Pat. No. 6,796,874 discloses a remote control running toy comprises a pair of uprights, each having a kingpin for steerably supporting the wheels; and a steering mechanism which is coupled through steering rods with the uprights; wherein the running toy comprises a coil-shaped spring member for absorbing a shock transmitted via the uprights to the steering rods. Thereby, the remote control running toy is provided, which is able to prevent the steering rods from being damaged, even if a strong shock acts onto the front wheels, thus improving the reliability of the running toy.

As can be seen, the known model cars tend to either have elaborate mechanisms imitating the actual, real vehicle, or alternatively, the structure of the known model cars are substantially distinguishable from the real vehicle.

Currently, despite the similarity in overall look and feel, as well as the similarity in internal parts layout of a model car with that of the corresponding actual car, the wheels of a model car is usually not disposed to be adjustable in relation to a base. Therefore, it is desirous to have a model car having an adjustable base in which the set of wheels of a model car can be adjusted in relation the base in both height and angle or camber.

SUMMARY OF THE INVENTION

A model car for adjusting a height between a base of the model and a surface is provided.

A model car for adjusting an angle between the base of the model and at least one wheel is provided.

The model car includes a base having a height adjustment aperture; an adjustment base member having a corresponding height adjustment receiving member; each of the at least one wheel axial elements is disposed at its center portion to be fitted upon the adjustment base member, wherein each of the at least one wheel axial elements has a center portion and two end portions, such that each has one end portion for connecting to a wheel; and a height adjusting bolt disposed to pass through the height adjusting aperture on the base and is connected to the adjustment base member by having a first end of the bolt secured upon the corresponding height adjustment receiving member.

The model car may also include a height adjustment elongated member mechanically coupled to the adjustment base member, the height adjustment elongated member having a center portion and two end portions, at least one end portion of the height adjustment elongated member being connected to the non-wheel end portion of the at least one wheel axial elements, the center portion of each the at least one wheel axial elements resting on a pivotal point provided by the adjustment base member; a angle adjustment bolt being disposed to pass through an angle adjustment opening on the base, extending further through the adjustment base member to connect with the center portion of the height adjustment elongated member, such that as the angle adjustment bolt is being adjusted, the height adjustment elongated member moves up or down causing each of the at least one wheel axial elements to oscillate about the pivotal point.

DETAILED DESCRIPTION OF THE INVENTION

The present invention provides a model car, which includes a height adjusting mechanism for wheels. The model car has an adjusting base, on which the shafts of wheels are mounted; and a height adjusting bolt, engaged with a height adjusting screw hole on the adjusting base through a height adjusting hole on the chassis from the outside; the diameter of the height adjusting through hole being smaller than that of the head of the height adjusting bolt.

The model car further comprises a camber adjusting mechanism. By turning the adjusting bolt exposing outside the bottom of the car, the wheels present varied height and camber relative to the body and the chassis of the car.

Figure 1:
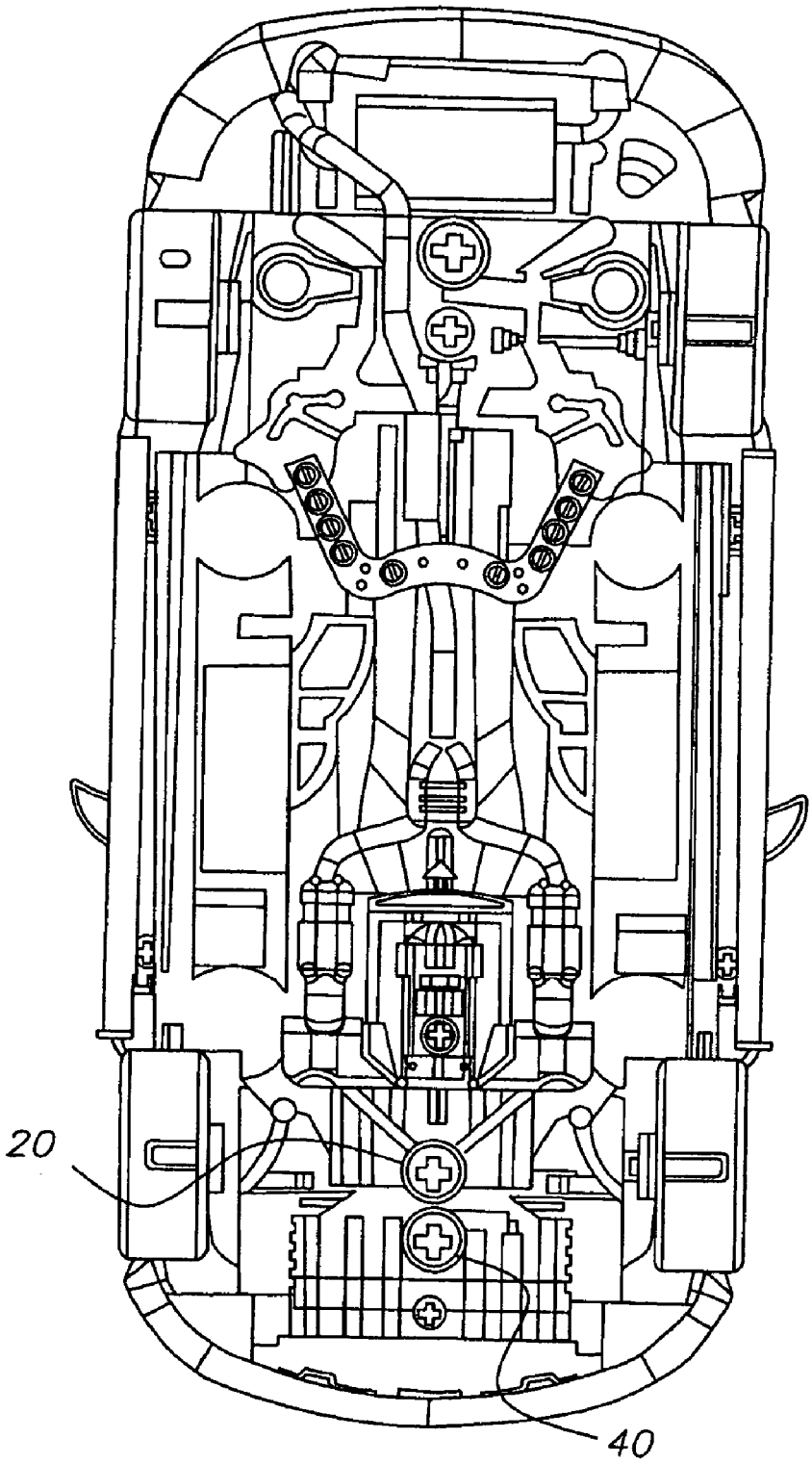
FIG. 1 shows a bottom view of model car of the present invention.
Figure 2:
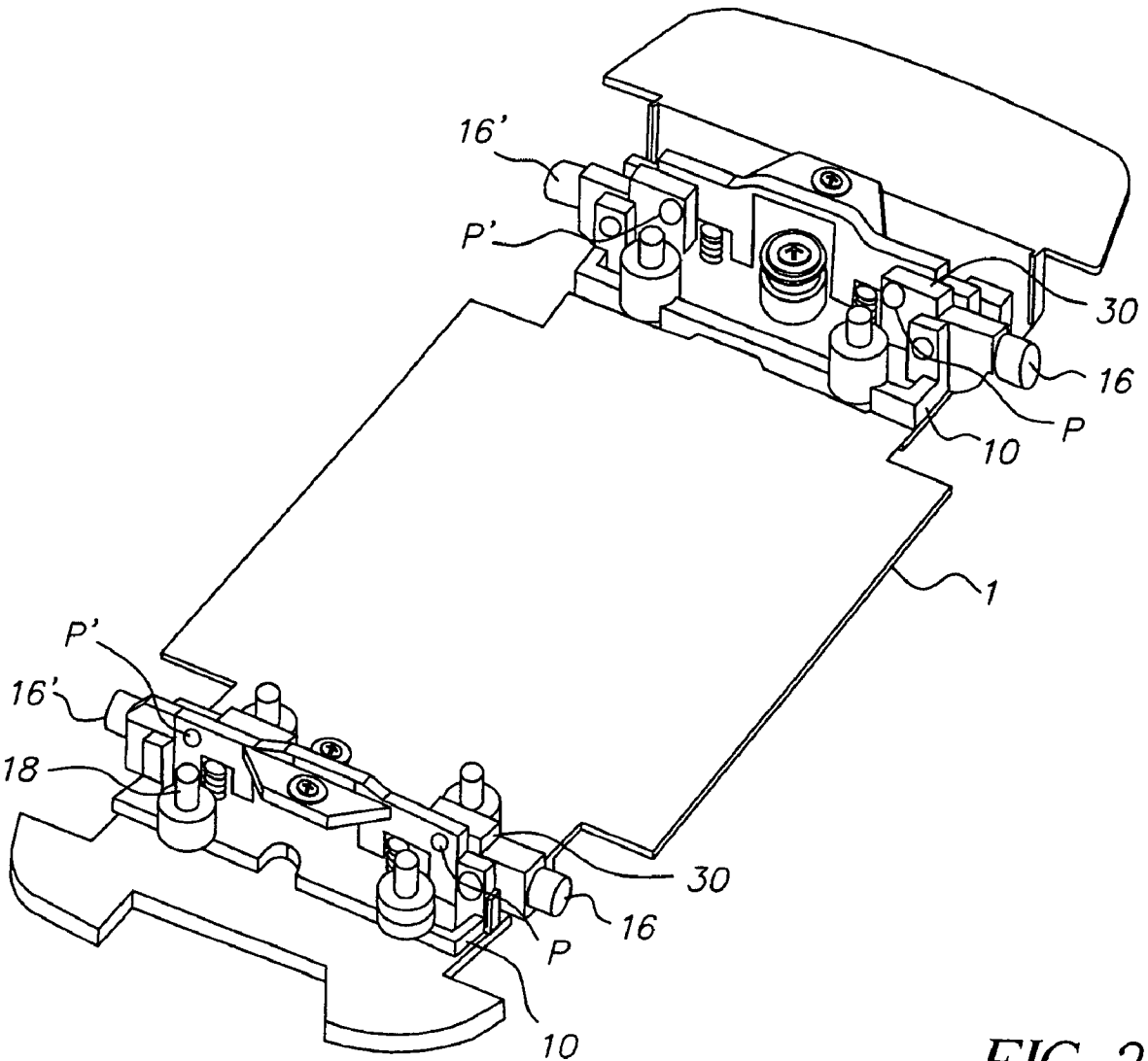
FIG. 2 shows a perspective view of the adjustable mechanism of the present invention mounted upon the base of a model car.
Figure 3:
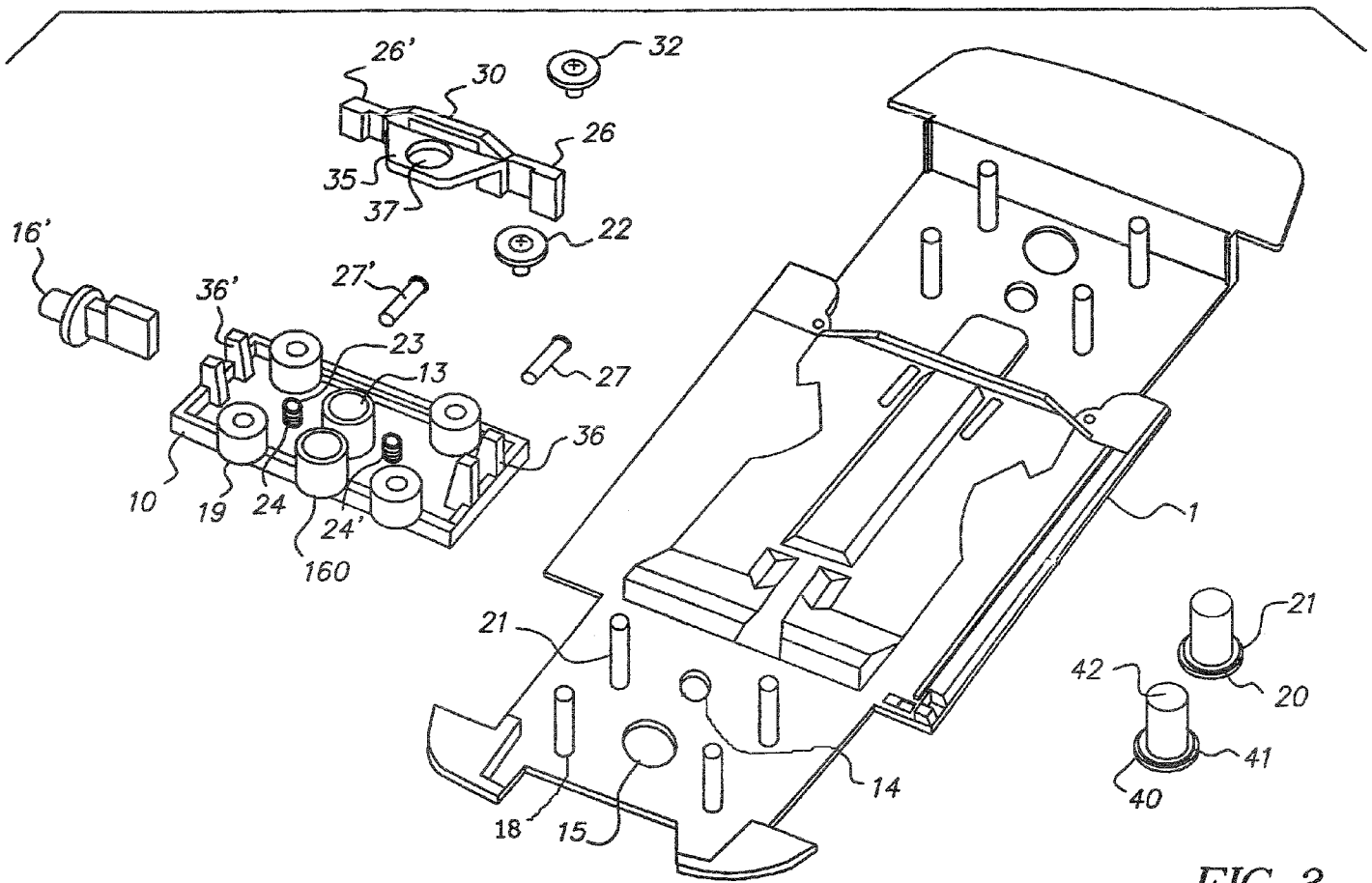
FIG. 3 shows a blow up view of FIG. 2.

Referring to FIGS. 1-3, a bottom view of model car of the present invention is shown. The model car comprises a base 1. Base 1 comprises a single piece member capable a being molded into suitable shapes that accommodate various parts such a wheel (not shown), etc. A height adjustment elongated member 30 is mounted upon an adjustment base member 10. Height adjustment elongated member 30 is used for adjusting a distance between a member connect to a wheel in relation to the base 1. In other words, the height of the model car in relation to a surface (not shown) in which the car operates can be adjusted.

An angle adjustment bolt 40 is positioned such that it extends from the outer surface of the model car through an angle adjustment opening 15 on base 1 and extends further through a corresponding threaded angle adjustment aperture 160 on adjustment base member 10. The diameter of angle adjustment opening 15 is greater than the outer diameter of a first or the nick end 41 of angle adjustment bolt 40. The second or terminal end 42 of angle adjustment bolt 40 is mechanically coupled to the center portion of height adjustment elongated member 30. As angle adjustment bolt 40 rotates, it engages height adjustment elongated member 30 causing the same to move either in an up or a down movement. A pair of wheel axial elements 16, 16' each having two ends is provided. Wheel axial elements 16 and 16' have substantially identical structures. The first end of wheel axial element 16 is connected to a wheel (not shown) or wheel assembly. The second end of wheel axial element 16 has an aperture disposed to receive a link pin 26. The end result is that wheel axial element 16 and link height adjustment elongated member 30 are movably engaged via pin 26. At the center portion of wheel axial element 16 an aperture is provided for a second link pin 27 to pass through the aperture at the center portion. On adjustment base member 10, a pair of seats 36 is diametrically formed to have the center portion of wheel axial element 16 disposed in-between. Seats 36 each has an aperture being disposed at its terminal end for each link pin 27 to pass through. In other words, each seat 36 has aperture disposed to receive second link pin 27. The elements 16, link pin 26, and second link pin 27 all have symmetrical counter elements, i.e. parts wheel axial elements 16', link pin 26', and second link pin 27'. Thereby a pair of pivotal points P, P' are provided at the proximity of second link pin 27 and second link pin 27' respectively.

Because the diameter of angle adjustment opening 15 is greater than the outer diameter of a first or the nick end 41 of angle adjustment bolt 40, angle adjustment bolt 40 can pass through and move in unison with adjustment base member 10. Thereby the angle adjustment of the present invention is independent of height adjustment which is shown infra.

While adjusting the leaning angle of the wheel or the leaning angles of a pair of wheels in relation to the model car body including base 1, a screw driver may be used upon a terminal of angle adjustment bolt 40 such as the nick end of the same. The rotation of angle adjustment bolt 40 in turn engages height adjustment elongated member 30 causing the same the move upside or downside. When height adjustment elongated member 30 is in the upside motion, its end portion is mechanically coupled to both wheel axial elements 16, 16' and causing the same to move upside as well. The movement causes wheel axial elements 16, 16' to oscillate in relation to pivotal points P, P' respectively. In turn, the end of wheel axial elements 16, 16' closer to the wheels rotates downward respectively. Since the wheel is mounted substantially at right angles with wheel axial elements 16 or 16', as can be seen, the top portion of the wheel leans toward outside and the bottom portion of the wheel leans toward inside. For a pair of wheels, the result is that a "\/" configuration of the wheels is achieved.

Similarly, the reverse of the above is also true in that when height adjustment elongated member 30 is in the downside motion, its end portion is mechanically coupled to both wheel axial elements 16, 16' and causing the same to move downside as well. The movement causes wheel axial elements 16, 16' to oscillate in relation to pivotal points P, P' respectively. The ends of wheel axial elements 16, 16' closer to the wheels rotate downward respectively. Since the wheel is mounted substantially at right angles with wheel axial elements 16 or 16', as can be seen, the top portion of the wheel leans toward inside and the bottom portion of the wheel leans toward outside. For a pair of wheels, the result is that a "/ \" configuration of a pair of wheels is achieved.

The mechanic coupling of height adjustment elongated member 30 and angle adjustment bolt 40 may be achieved as follows: a flange 35 may be formed out of height adjustment elongated member 30 and at the center of height adjustment elongated member 30. A through hole 37 is formed on flange 35. Angle adjustment bolt 40 extends through hole 37. At an end of bolt (the opposite end of the nick end) a threaded hole is formed to receive screw 32. Screw 32 has a nick end that has a diameter greater than hole 37.

A set of energized support springs 23 is positioned between adjustment base member 10 and height adjustment elongated member 30. When angle adjustment bolt 40 threads or moves upwards, the recovering force of energized support springs 23 cause height adjustment elongated member 30 to move upward. The upward movement is stopped or limited by the nick end of screw 32. Similarly, the reverse of the above is also true in that when angle adjustment bolt 40 threads or moves downwards, the pressing force exerted by screw 32 causes height adjustment elongated member 30 to move downward, thereby compressing energized support springs 23 further. Therefore, height adjustment elongated member 30 moves in unison with angle adjustment bolt 40 in either an upward or a downward movement.

Energized support springs 23 may be positioned between height adjustment elongated member 30 and adjustment base member 10. Energized support springs 23 may also be mounted upon angle adjustment bolt 40. Alternatively, as shown in FIG. 3, on adjustment base member 10 there are protrusions 24, 24' corresponding to two energized support springs 23 to accommodate the same respectively.

In order to limit the upward movement of adjustment base member 10 due to the rotation of height adjustment bolt 20, stopping screw 22 is used to stop the movement. Stopping screw 22 is threaded into a threaded opening at the opposite end 21 of height adjustment bolt 20. Opposite end 21 is the end opposite to the nick end of height adjustment bolt 20. The outer diameter of stopping screw 22 is greater than the outer diameter of opposite end 21 of height adjustment bolt 20. Thus, when using height adjustment bolt 20, if adjustment base member 10 touches stopping screw 22 during adjustment, the movement of adjustment base member 10 stops.

For a smoother adjustment process, two protrusions or bases each having a threaded center are formed on adjustment base member 10. The protrusions are disposed opposite to a height adjustment aperture 14 and wheel axial elements 16 respectively. Therefore, the result is that the threaded portions are suitably lengthened; thereby better meshing is achieved for both height adjustment bolt 20 and angle adjustment bolt 40.

Similar to angle adjustment bolt 40, height adjustment bolt 20 has a portion which is accessible from the outside of model car, e.g. the outer portion of base 1. This configuration is suitable easy of access in the adjusting process in that an operator (not shown) may use a screw driver upon the nick end of height adjustment bolt 20 for adjustment purposes. Height adjustment bolt 20 passes through height adjustment aperture 14 on base 1. Height adjustment bolt 20 extends further and is coupled to a height adjustment threaded aperture 13 on adjustment base member 10. The end result is that the look and feel of the model car changes at least in height when height adjustment bolt 20 is adjusted.

In addition, positioning elements may be provided on both base 1 and adjustment base member 10. Elements 18 may be formed on base 1. Element 19 may be formed on adjustment base member 10. The result is that a limited one dimensional movement is achieved during adjustment such as the height adjustment. In this embodiment, there are four elements 18 and necessarily four corresponding elements 19.

The present invention provides a mechanism for the adjustment of model car wheels in relation to model car body or base. The present invention provides an overall effect, wherein the look and feel of the model can be varied.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A model car comprising:

a base having a height adjustment aperture;

an adjustment base member having a corresponding height adjustment receiving member;

wherein a wheel axial element is disposed at its center portion to be fitted upon the adjustment base member, wherein said wheel axial element has a center portion and two end portions, such that each has one end portion for connecting to a wheel;

a height adjusting bolt disposed to pass through the height adjusting aperture on the base and is connected to the adjustment base member by having a first end of the bolt secured upon the corresponding height adjustment receiving member;

a height adjustment elongated member mechanically coupled to the adjustment base member, the height adjustment elongated member having a center portion and two end portions, at least one end portion of the height adjustment elongated member being connected to the non-wheel end portion of the said wheel axial element, the center portion of each said wheel axial element resting on a pivotal point provided by the adjustment base member;

a angle adjustment bolt being disposed to pass through an angle adjustment opening on the base, extending further through the adjustment base member to connect with the center portion of the height adjustment elongated member, such that as the angle adjustment bolt is being adjusted, the height adjustment elongated member moves up or down causing each of said wheel axial element to oscillate about the respective pivotal point.

2. The model car of claim 1, wherein the diameter of the angle adjustment opening being greater than the diameter of the angle adjustment bolt.

* * * * *